US005209516A

United States Patent [19]

Arduin et al.

[11] Patent Number: 5,209,516

[45] Date of Patent: May 11, 1993

[54] SAFETY SKI BINDING

[75] Inventors: Joel Arduin, Annecy-Le-Vieux; Pascal Thomas, Chambery, both of France

[73] Assignee: Salomon S. A., Chavanod, France

[21] Appl. No.: 833,163

[22] Filed: Feb. 10, 1992

[30] Foreign Application Priority Data

Feb. 8, 1991 [FR] France ..... 91 01481

[51] Int. Cl.[5] ..... A63C 9/084

[52] U.S. Cl. ..... 280/633

[58] Field of Search ..... 280/611, 623, 631, 633, 280/607, 634, 632, 636, 618, 601, 626

[56] References Cited

U.S. PATENT DOCUMENTS

| | | | |
|---|---|---|---|
| 4,522,424 | 6/1985 | Luitz et al. | 280/633 |
| 4,589,674 | 5/1986 | Krob et al. | 280/633 |
| 4,620,719 | 11/1986 | Stritzl | 280/633 |
| 4,699,397 | 10/1987 | Freisinger et al. | 280/633 |
| 4,699,398 | 10/1987 | Luschnig et al. | 280/633 |
| 5,096,218 | 3/1992 | Bardin | 280/633 |
| 5,102,158 | 4/1992 | Erdei et al. | 280/633 |

FOREIGN PATENT DOCUMENTS

| | | |
|---|---|---|
| 383039B | 5/1987 | Austria . |
| 0098515 | 6/1983 | European Pat. Off. . |
| 8808415 | 9/1988 | Fed. Rep. of Germany . |
| 2614540 | 11/1988 | France . |

*Primary Examiner*—Richard M. Camby

*Attorney, Agent, or Firm*—Pollock, Vande Sande & Priddy

[57] ABSTRACT

Ski safety binding comprising, on its frontal surface (1*b*) opposite the surface on which the jaw is positioned, a control device (9) a control lever extending opposite to the jaw and beyond the body (1) of the binding, and mounted so as to pivot on the body (1) around a horizontal, transverse axis (11), an intermediate point (13) of the control lever (9) being connected to the end portion (5*c*) of a locking device (5) located on the second frontal surface (1*b*) of the body (1), in such a way that lifting the control lever (9) causes upward pivoting of locking device (5) and movement from its locked to its released position.

8 Claims, 3 Drawing Sheets

SAFETY SKI BINDING

FIELD OF THE INVENTION

The present invention relates to a safety ski binding whose longitudinal position on the ski is adjustable, thereby permitting this binding to be adjusted to the length of a boot to be secured in position on the ski.

BACKGROUND OF THE INVENTION

Use is currently made of various kinds of devices making it possible to adjust, on the ski, the longitudinal position of a safety binding which holds the front of a boot (front stop) or the rear of the boot (heel piece) in position. Generally, the heel piece may be moved longitudinally in relation to the front stop mounted in a stationary position on the ski, so as to fit the front stop/-heel piece unit to a ski boot of determinate length.

As described in Patents Nos. FR-A-2 451 756 and FR-A-2 614 545, heel pieces are known which, in order to allow adjustment of their position, comprise a longitudinal slide-track attached to the ski, a body mounted so as to slide along this slide-track, and a locking device mounted so as to swivel vertically on the body of the heel piece. This locking device has, on its lower surface, projecting teeth designed to engage in corresponding holes longitudinally aligned in the slide track, thereby forming a rack. The locking device is acted upon elastically, for example by utilizing the return energy of the return spring belonging to the heel piece, such that its teeth tend to become engaged in holes in the corresponding slide-track in the desired longitudinal position. With this kind of heel piece and when modification of its longitudinal position is desired, a tool, e.g., a screwdriver, is engaged in the rear of the heel piece to raise the locking device and cause it to swivel upward, so as to disengage the teeth on the locking device from the holes in the slide-track, thereby making it possible to cause the body of the heel piece to slide on the slide-track. While these devices make possible a relatively simple adjustment of the longitudinal position of the heel piece, they nevertheless have the disadvantage of requiring the use of a tool to perform this adjustment.

Patent No. AT-A-340 293 describes another type of heel piece in which the locking device holding the body of the heel piece in longitudinal position is constituted by the two end pieces, folded transversely toward each other, of an elastic buckle which extends along the slide-track and parallel to it, and beyond the posterior end of the body of the heel piece. This elastic buckle can pivot around the transverse axis given material form by the end two pieces which, by being bent toward each other, constitute locking fingers engaged in the holes in the sides of the slide-track. The body of the binding is released by pivoting the buckle unit upward and forward, this pivoting motion causing, by virtue of the provision of suitable inclined pieces, the end parts of the buckle, or locking fingers, to spread apart and to be released laterally from the holes in the slide-track. While this binding offers the advantage of eliminating the need for a tool for adjustment of its longitudinal position, it nevertheless possesses the disadvantage that the body of the heel piece may be unlocked accidentally when a forward-directed blow struck on the buckle causes the accidental pivoting of this buckle, as often occurs when skis are engaged in bags in the compartments of ski lifts.

SUMMARY OF THE INVENTION

The present invention seeks to overcome the problems of conventional safety bindings, by producing a safety binding in which the unlocking of the sliding body for the purpose of longitudinal position adjustment does not require the use of a tool, is accomplished by a natural motion of one hand, and can, under no circumstance, be caused by a shock exerted on its control element.

To this end, this safety ski binding comprising a body carrying, on a first frontal surface, a movable jaw which locks an end of a boot on the ski, this body being mounted so as to slide on a longitudinal slide-track fastened to the ski and capable of being locked in an adjustable longitudinal position on this slide track by means of a locking device mounted so as to swivel vertically on the body, this locking device being acted upon elastically by a spring and incorporating at least one lower tooth which can be engaged in a locked position in one of several holes formed in the longitudinal slide-track and spaced apart longitudinally, is characterized by the fact that this binding comprises, on a second frontal surface set opposite the surface bearing the jaw, a control element constituting a second-class lever extending opposite to the jaw and beyond the body of the binding and mounted in a pivoting arrangement on the body around a horizontal, transverse axis, an intermediate point of the control lever being connected, by means of connecting means, to the end part of the locking device positioned on the second frontal surface of the body, such that raising the control lever by applying a force beneath its free, gripping end, causes the locking device to pivot upward and to move from its locked to its released position.

BRIEF DESCRIPTION OF THE DRAWINGS

Various embodiments of the present invention will be described below, by way of example, with reference to the attached drawings in which.

DETAILED DESCRIPTION

Figure 1:
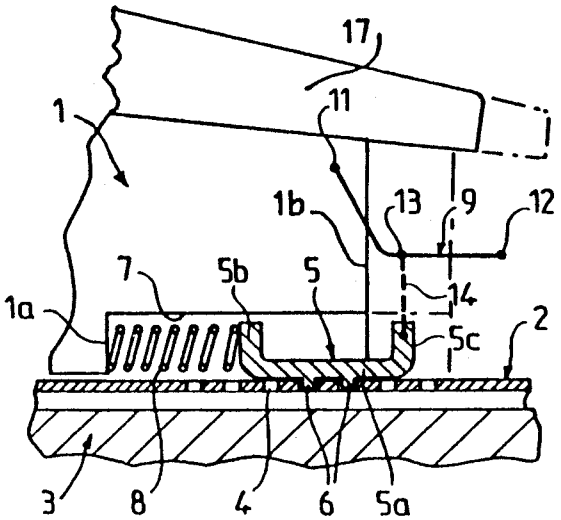
FIGS. 1 and 2 are schematic vertical and longitudinal cross-sections of a heel piece according to the invention, in the locked and unlocked positions respectively of its body, which is mounted so as to slide on a slide-track.
Figure 2:
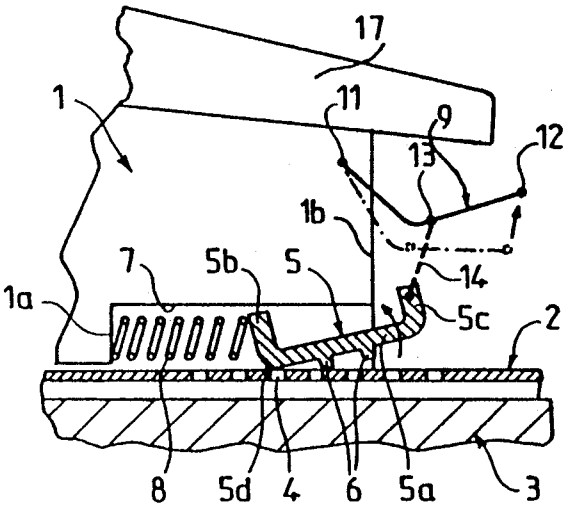

FIGS. 1 and 2 schematically show the rear part of a heel piece according to the invention. This heel piece comprises a body 1 which carries, on its anterior frontal surface, a pivoting jaw which locks the rear part of the boot in place and whose pivoting motion may be manually controlled using a release lever, this jaw and this release lever being omitted from FIGS. 1 and 2 for the sake of density. The body 1 is mounted so as to slide longitudinally on a slide-track 2, which is itself attached to the upper surface of a ski 3. The central raised part of this slide-track comprises several holes 4 spaced apart longitudinally, thereby forming a rack. This rack cooperates with a locking piece 5 which swivels vertically and is housed in the lower, rear portion of the body 1. The locking piece 5 is constituted by a plate 5*a* whose lower surface carries teeth 6 projecting downward and designed to be engaged in some of the holes 4, depending upon the longitudinal position desired for the body 1. The swivelling locking device 5 is housed in a recess 7 provided in the lower rear portion of the body 1, and is subjected to the action exerted by a spring 8 supported on the body 1, so that the lower teeth 6 on the locking device 5 are always elastically stressed toward the holes 4 in the slide-track 2. In the embodiment illustrated in FIGS. 1 and 2, the spring 8 is the return spring on the heel piece which is compressed longitudinally between a front support shoulder 1*a* fitted transversely into the lower part of the body 1, and a front heel 5*b* of the locking piece 5, this front heel 5*b* being bent upward at a right angle in relation to the plate 5*a* of the locking piece 5, which is horizontal and in contact with the upper surface of the slide track 2 in which the holes are provided.

The rear frontal surface lb of the body of the heel piece according to the invention is provided with a control element 9 making it possible to raise the locking piece 5 and to cause it to swivel in opposition to the action of the return spring 8, so as to cause it to shift from its locked position (FIG. 1), in which its lower teeth 6 are engaged in holes 4 in the slide-track 2, to its unlocked position (FIG. 2), in which the teeth 6 are disengaged above these holes 4. The control element 9 is a lever mounted so as to pivot at its front end, around a horizontal, transverse pin 11 housed in the upper, rear part of the body 1. The free, rear end 12 of the lever 9 may be gripped and raised, and an intermediate connection point 13 of the control lever 9 is connected to the rear part 5*c* of the pivoting locking device 5 by mechanical connection means 14. In consequence, when the control lever 9 is raised from its lower, locked position (FIG. 1), it pivots counter-clockwise around its transverse pin 11 (FIG. 2) and the connection point 13 is raised, thereby causing, by means of the connection means 14, lifting of the rear part 5*c* of the locking device and, consequently, the pivoting of the locking device into the unlocked position. This pivoting motion occurs around the transverse axis delimited by the front area of contact 5*d* located at the site of the lower edge connecting the front heel 5*b* and the plate 5*a* of the locking device 5. When upward stresses cease to be exerted on the rear gripping end 12 of the control lever 9, the swivelling, locking device 5, subjected to the action of the return spring 8, pivots clockwise so as to return to the locked position, thereby producing the effect, by means of the connection mechanism, of drawing the control lever 9 back into the lower, locked position.

The type of binding diagrammatically illustrated in FIGS. 1 and 2 further incorporates a voluntary release lever 17 whose rear part only is shown. In a conventional manner, this lever controls the opening of the jaw by going from a high to a lower position, as illustrated in these figures. The longitudinal position of the body is most frequently adjusted when the jaw is in the raised position, and thus when the lever 17 is in the lowered position.

Because of the construction described above, the heel piece-unlocking operation is very easily accomplished by means of a pinching motion between the user's thumb and index finger, one of these fingers resting on the top of the release lever 17 and the other being engaged beneath the rear, gripping end 12 of the control lever 9. Furthermore, the user inserts the boot into the heel piece with the jaw open, so as to make it possible to place the body 1 of the heel piece in its proper position. Thus, the user unlocks the locking piece 5 with one hand, by squeezing together the control lever 9 and the release lever 17, and with the other hand, holds the shoe while inserting it into the jaw of the heel piece. While keeping the locking piece 5 in the raised, unlocked position with one hand, the user guides the body 1 of the heel piece and causes it to slide with this same hand in order to position it correctly. Once this position is reached, the user releases the control lever 9, thereby releasing the pivoting locking device 5, which is returned to the locked position (FIG. 1) by means of the return spring 8. The user also exerts vertical, downward pressure on the boot, in order to lock the binding in position by swivelling the jaw downward, thereby causing the body 1 of the heel piece to move backward on the slide-track 2 in relation to the locking piece 1, which is then immobilized in the locked position, the body 1 and the release lever 17 then occupying the positions illustrated in dot-and-dash lines in FIG. 1. The locking piece 5 is then latched in its locked position as soon as the body 1 moves backward, i.e., as soon as a boot is effectively inserted in the heel piece. To this end, the upper wall of the recess 7 in which the locking piece 5 is housed is displaced rearward sufficiently to be positioned above the rear tongue 5*c* of the locking piece 5, as shown in dot-and-dash lines in FIG. 1. This rear tongue 5*c* is then prevented from being raised, and the locking piece 5 is thus held with precision in the locked position.

Figure 3:
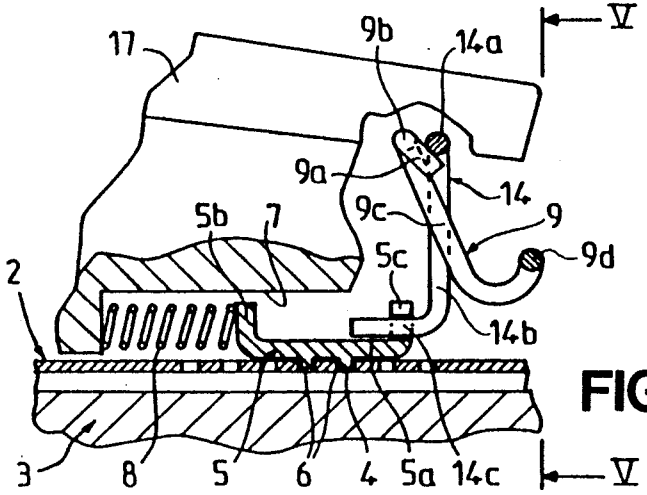
FIGS. 3 and 4 are schematic vertical and longitudinal cross-sections of a first embodiment of a heel piece according to the invention, in the locked and unlocked positions of its body, respectively.
Figure 6:
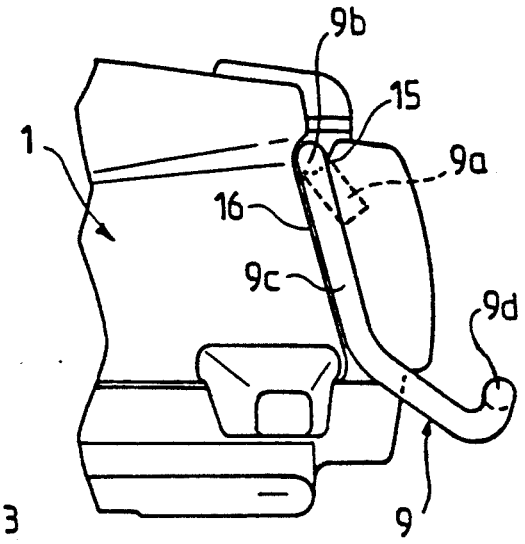
FIG. 6 is a raised view of the rear part of the body of the heel piece, on which the control lever is mounted.
Figure 7:
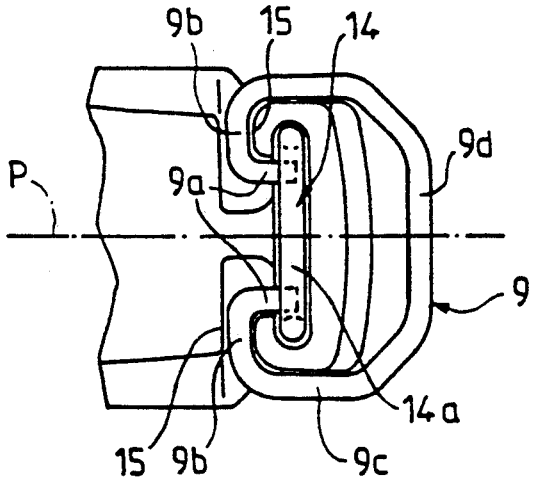
FIG. 7 is a plane view of the rear part of the body of the heel piece, the heel piece-release lever being presumed to have been removed.
Figure 8:
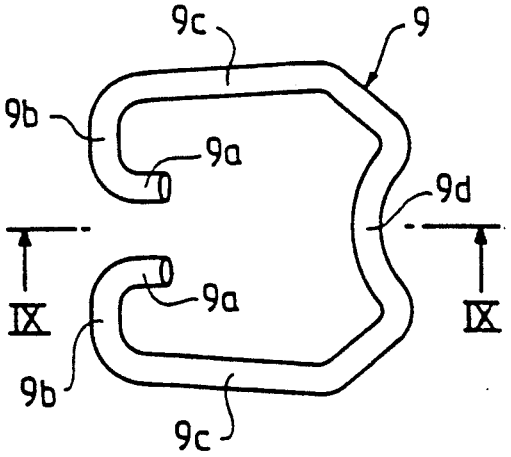
FIG. 8 is a plane view of the control lever of the heel piece according to FIGS. 3 to 7.
Figure 9:
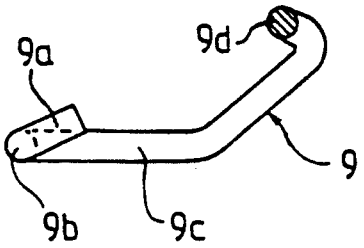
FIG. 9 is a cross-section along line IX—IX in FIG. 8.

A first embodiment of the heel piece according to the invention will now be described, with reference to FIGS. 3 to 9. In this heel piece the control lever 9 is constituted by a substantially C-shaped loop of rigid wire, illustrated more especially in FIGS. 8 and 9. This loop is symmetrical in relation to the vertical, longitudinal plane of symmetry P of the heel piece, and it comprises, on each side of this plane, an end part 9*a* in proximity to the plane of symmetry P and sloping downward and rearward in the locked position, as shown in FIGS. 3 and 6. This end part 9*a* is extended to the outside by a horizontal, transverse section 9*b* inserted in a housing formed by a corresponding horizontal, transverse recess 15 provided in the upper, rear portion of the body 1. The two opposite transverse sections 9*b*, which extend toward each other, are coaxial and give material form to the transverse pivoting axis 11 of the control lever 9. Each transverse section 9*b* forming a swivel pin is extended, in turn, by a lateral arm 9*c* which runs downward, along and outside of the body 1. Each lateral arm 9*c* is preferably inclined downward and rearward, and, as seen transversely, forms an angle of approximately 25°, for example, with the end part 9a. In the locked position, the two lateral arms 9c are pressed against respective lateral stops 16 in the body 1. These stops may be constituted by flat support surfaces inclined downward and rearward. The ends of the two lateral arms 9c are interconnected by means of a rear transverse arm 9d forming a gripping handle, whose central part may be elevated to facilitate the insertion of a finger beneath this central part.

The connection means 14 are constituted by a rod in a reversed U shape, vertically movable, and comprising a horizontal, transverse upper core 14a located slightly to the rear of the transverse sections 9b, which forms the swivel pin for the control lever and is positioned substantially at the level of these sections. The two inclined end parts 9a of the control lever 9 are supported beneath this upper core 14a, which is extended downward, on each side, by a vertical arm 14b, the two vertical arms 14b running respectively on either side of the mechanism, and, in particular, of the cap which adjusts the hardness of the heel piece (not shown). The lower end of each vertical arm 14b curves forward so as to form a lower end arm 14c which is substantially horizontal and extends longitudinally forward. Each lower end arm 14c of the rod 14 passes beneath the end part of a horizontal, transverse upper tongue 5c constituting the rear part of the pivoting locking piece 5 attaching to the connection rod 14. Each arm 14c may slide longitudinally underneath the tongue 5c belonging to the locking piece so as to follow the return movements described by the body 1 during skiing in relation to the locking device 5 and in opposition to the elastic return force generated by the spring 8. The length of the arms 14c is at least equal to the amplitude of this return motion.

Figure 4:
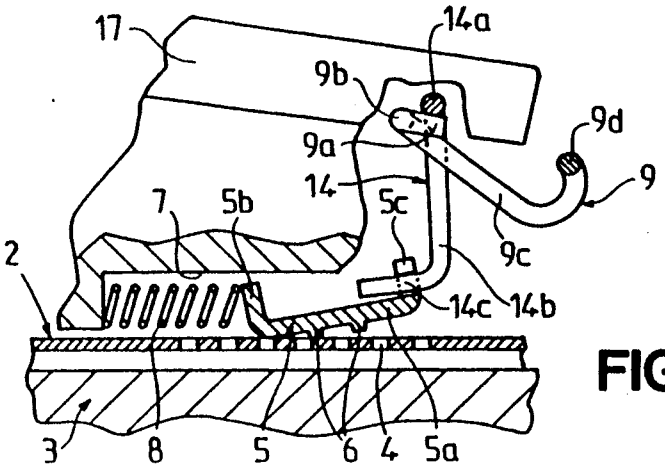
Figure 5:
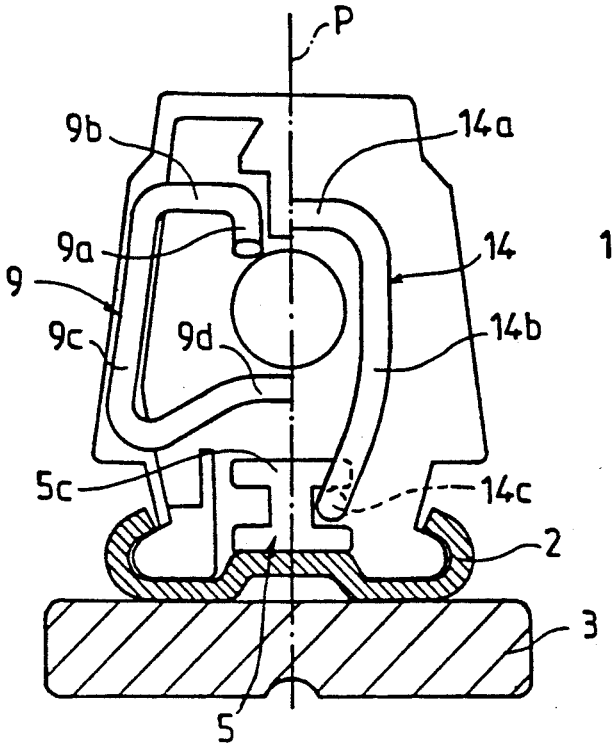
FIG. 5 is a transverse, vertical cross-section along line V—V in FIG. 3, the right half of this figure illustrating one-half of the connecting rod, and the left half, one-half of the control lever.

As can be seen in FIG. 3, in the locked position, the rear transverse gripping arm 9c on the control lever 9 is positioned substantially perpendicularly to the rear end of the release lever 17 of the heel piece, when this lever is in the low positioned on the body 1, as shown in FIGS. 3 and 4. This position corresponds to the upper, or open position of the jaw (not shown) mounted so as to swivel on the front part of the body 1.

The force required to cause the locking device 5 to swivel into the unlocked position is, reduced by the relation of the lever arms of the control lever 9. Accordingly, the user need supply only a slight force to operate the control buckle. Furthermore, a shock or blow struck from behind on the control lever 9 tends to flatten the control buckle 9 against the body, thereby producing no effect on the locking device.

Figure 10:
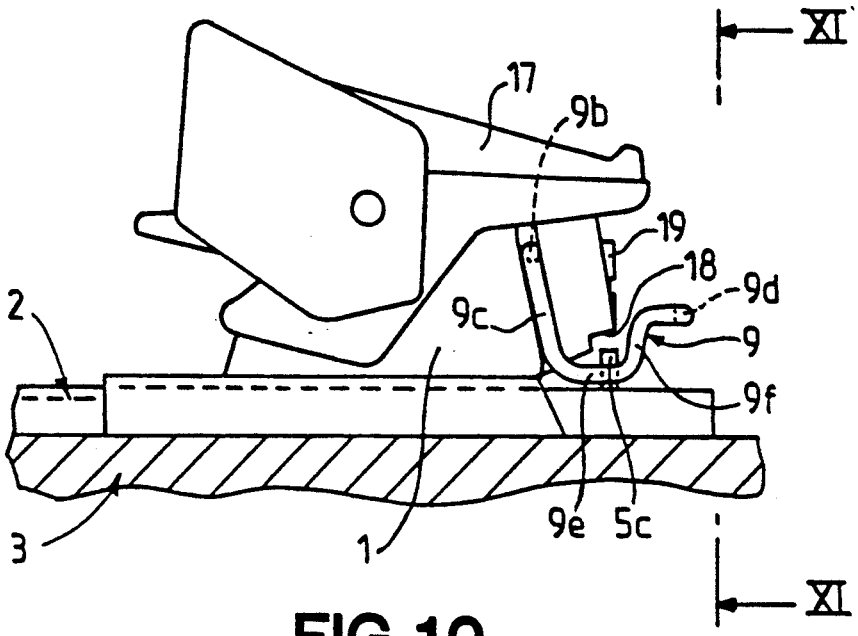
FIG. 10 is a raised view of a second embodiment of a heel piece according to the invention.
Figure 11:
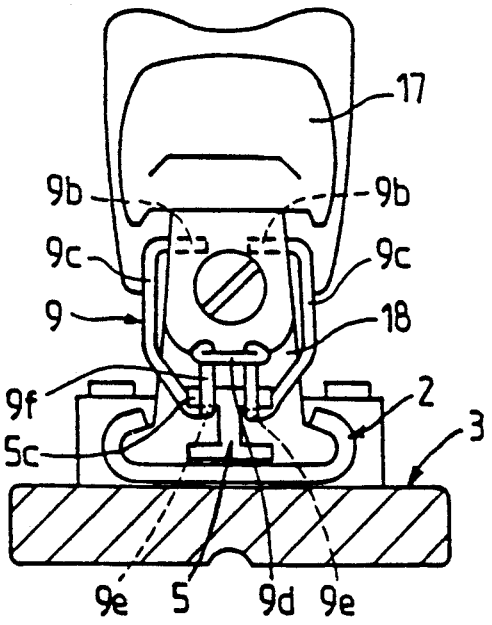
FIG. 11 is a vertical, transverse cross-section along line XI—XI in FIG. 10.
Figure 12:
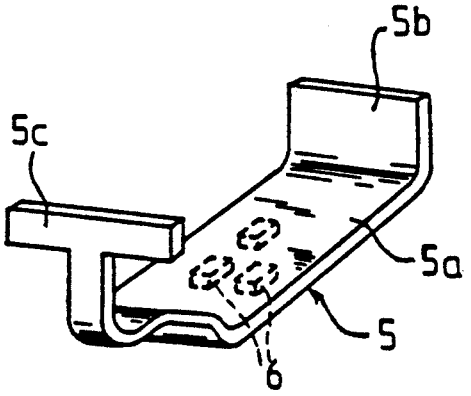
FIG. 12 is a perspective view of the locking piece of the heel piece shown in FIGS. 10 and 11.

In the variant illustrated in FIGS. 10 to 12, the connection rod 14 and the end parts 9a of the control lever 9 are eliminated, and the control lever 9 acts directly on the locking device 5. To this end, this control lever 9 comprises, between the inclined lateral arms 9c and the rear transverse gripping arm 9d, intermediate horizontal segments 9e extending, respectively, underneath the lateral portions of the rear transverse tongue 5c of the locking device 5 which, for this purpose, extends sufficiently rearward, to the outside and beyond the body 1. The intermediate horizontal segments 9e of the control lever 9 are extended upward and rearward by arms 9f which converge upward and toward the rear transverse arm 9d forming a gripping handle. During return movements described by the body during skiing, the horizontal segments 9e of the control lever slide underneath the tongue 5c of the locking device. The length of the arms is at least equal to the amplitude of the return motion of the body.

Consequently, when the user raises the control lever 9 to shift the heel piece into the unlocked position, the lateral portions of the rear horizontal tongue 5c of the locking device 5, which are, lifted by the two intermediate segments 9e of the control lever 9, slide along these segments. To allow the rear tongue 5c of the locking device 5 to be lifted sufficiently, the lower part of the body 1 incorporates a recess 18 located above this rear tongue. As illustrated in FIG. 10, this recess 18 is located beneath the cap 19 adjusting the hardness of the heel piece. The wall delimiting the recess 18 constitutes a stop for the tongue 5c of the locking device. The pivoting motion of the control lever 9 is thus limited by the fact that the locking piece comes to be stopped against the wall of the recess 18. The control lever 9 produces, moreover, a reduction in the stress required to raise the locking device. Because of the position of the gripping arm 9d in relation to the sections 9d around which the lever swivels, a shock generated from behind tends to flatten the locking device against the body 1, and produces no direct action on the locking device.

What is claimed is:

1. Ski safety binding comprising a body (1) carrying, on a first frontal surface, a movable jaw adapted for locking an end of a boot on a ski, said body being mounted so as to slide on a longitudinal slide-track (2) attached on said ski and capable of being locked in an adjustable longitudinal position on said slide-track (2) by means of a locking device (5) mounted so as to pivot about a horizontal axis on said body (1), said locking device (5) being acted upon elastically by a spring (8) and comprising at least one lower tooth (6) capable of being engaged, in the locked position, in one of several holes (4) formed in said longitudinal slide-track (2) and spaced apart longitudinally, wherein said safety binding comprises, on a second frontal surface (1b) opposite said first frontal surface on which said jaw is positioned, a control lever (9) having a free gripping end and being constituted by a substantially C-shaped rigid wire loop whose end portions comprise horizontal, transverse sections (9b) extending toward each other and engaged in respective housings (15) forming bearings in said body (1) and giving material form to a transverse pivoting axis (11) of said control lever (9), said control lever (9) having an intermediate point (13) connected, by connection means (14 to an end part (5c) of said locking device (5) located adjacent said second frontal surface (1b) of said body (1), so that raising said control lever (9) by applying a force beneath said free, gripping end (12) causes said locking device (5) to pivot upward and to move from a locked position to an unlocked position.

2. Ski safety binding according to claim 1, wherein each of said transverse sections (9b) giving material form to the pivoting axis of said control lever (9) is extended to the outside by a lateral arm (9c) which extends downward, along and to the outside of said body (1), and wherein the ends of said two lateral arms (9c) are interconnected by a transverse arm (9d) forming a gripping handle.

3. Ski safety binding according to claim 2, wherein said two lateral arms (9c) of said control lever (9) are, in locked position, pressed against respective lateral stops (16) on said body (1).

4. Ski safety binding according to claim 3, wherein said lateral stops (16) are constituted by flat support surfaces inclined in relation to the horizontal.

5. Ski safety binding according to claim 1, wherein said connection means are constituted by a rod in a reversed U shape and vertically movable on said body (1), and which comprises an upper horizontal, transverse core (14*a*) located in proximity to said transverse section (9*b*) giving concrete form to said pivoting axis of said control lever (9) and positioned substantially at their level, this upper core (14*a*) being extended downward, on each side, by a vertical arm (14*b*) whose lower end is curved so as to form a lower, substantially horizontal end arm (14*c*) which, extending longitudinally, ensures coupling with said end part (5*c*) of said locking device (5), and wherein said control lever (9) terminates in two end parts (9*a*) connecting with said transverse sections (9*b*), said two end parts (9*a*) being inclined in locked position and being supported beneath said upper core (14*a*) of said connection rod (14).

6. Ski safety binding according to claim 1, wherein said control lever (9) comprises inclined lateral arms (9*c*) and a transverse arm (9*d*) forming a gripping handle, and intermediate horizontal segments (9*e*) disposed between said lateral arms and transverse arm and extending, respectively, underneath lateral parts of an upper transverse tongue (5*c*) of said locking device (5), whereby said control lever (9) acts directly on said locking device (5).

7. Ski safety binding according to claim 6, wherein said body (1) has a lower portion incorporating a recess (18) located above said upper transverse tongue (5*c*) of said locking device (5).

8. Ski safety binding according to claim 6, wherein said intermediate horizontal segments (9*e*) are extended upward by arms (9*f*) which converge upward and toward said transverse arm (9*d*) forming said gripping handle.

* * * * *